US007986213B2

(12) United States Patent
Feichtinger et al.

(10) Patent No.: US 7,986,213 B2
(45) Date of Patent: Jul. 26, 2011

(54) MULTI-LAYERED COMPONENT WITH SEVERAL VARISTORS HAVING DIFFERENT CAPACITIES AS AN ESD PROTECTION ELEMENT

(75) Inventors: Thomas Feichtinger, Graz (AT); Thomas Pürstinger, Graz (AT)

(73) Assignee: Epcos AG, Munich (DE)

( * ) Notice: Subject to any disclaimer, the term of this patent is extended or adjusted under 35 U.S.C. 154(b) by 630 days.

(21) Appl. No.: 11/720,704

(22) PCT Filed: Dec. 2, 2005

(86) PCT No.: PCT/DE2005/002183

§ 371 (c)(1),
(2), (4) Date: Jul. 5, 2007

(87) PCT Pub. No.: WO2006/058533

PCT Pub. Date: Jun. 8, 2006

(65) Prior Publication Data

US 2008/0186127 A1 Aug. 7, 2008

(30) Foreign Application Priority Data

Dec. 3, 2004 (DE) ..... 10 2004 058 410

(51) Int. Cl.
*H01C 7/10* (2006.01)

(52) U.S. Cl. ..... 338/20; 338/307; 338/309

(58) Field of Classification Search ..... 338/20, 338/307–309

See application file for complete search history.

(56) References Cited

U.S. PATENT DOCUMENTS

| | | | | |
|---|---|---|---|---|
| 4,460,623 | A * | 7/1984 | Levinson | 427/101 |
| 4,947,286 | A | 8/1990 | Kaneko et al. | |
| 5,075,665 | A | 12/1991 | Taira et al. | |
| 5,324,986 | A | 6/1994 | Ueno et al. | |
| 5,590,016 | A * | 12/1996 | Fujishiro et al. | 361/313 |
| 5,880,925 | A * | 3/1999 | DuPre et al. | 361/303 |
| 6,346,871 | B1 * | 2/2002 | Ogasawara et al. | 338/21 |
| 6,608,547 | B1 | 8/2003 | Greier et al. | |
| 7,084,732 | B2 | 8/2006 | Krumphals | |
| 7,135,955 | B2 | 11/2006 | Feichtinger et al. | |
| 7,359,178 | B2 | 4/2008 | Feichtinger et al. | |
| 7,403,083 | B2 | 7/2008 | Engel et al. | |
| 7,449,405 | B2 | 11/2008 | Feichtinger et al. | |
| 7,710,233 | B2 | 5/2010 | Feichtinger et al. | |
| 7,710,710 | B2 | 5/2010 | Brunner et al. | |
| 2004/0195734 | A1 | 10/2004 | Teraura | |
| 2005/0062582 | A1 | 3/2005 | Feichtinger et al. | |

(Continued)

FOREIGN PATENT DOCUMENTS

DE 39 30 000 3/1990

(Continued)

OTHER PUBLICATIONS

International Search Report for PCT/DE05/002183.

(Continued)

*Primary Examiner* — Kyung Lee
(74) *Attorney, Agent, or Firm* — Fish & Richardson P.C.

(57) ABSTRACT

An electrical component includes a first varistor and a second varistor. The first varistor includes first electrodes and ceramic between the first electrodes. At least part of the first electrodes overlap vertically. The second varistor includes second electrodes and ceramic between the second electrodes. The second electrodes are in a substantially same horizontal plane.

22 Claims, 4 Drawing Sheets

U.S. PATENT DOCUMENTS

| | | | |
|---|---|---|---|
| 2006/0057830 | A1 | 3/2006 | Feichtinger et al. |
| 2006/0104002 | A1 | 5/2006 | Engel et al. |
| 2006/0120016 | A1 | 6/2006 | Feichtinger et al. |
| 2006/0170010 | A1 | 8/2006 | Brunner et al. |
| 2006/0249758 | A1 | 11/2006 | Feichtinger et al. |
| 2007/0235834 | A1 | 10/2007 | Brunner et al. |
| 2007/0271782 | A1 | 11/2007 | Block et al. |
| 2008/0186127 | A1 | 8/2008 | Feichtinger et al. |
| 2009/0035560 | A1 | 2/2009 | Block et al. |
| 2009/0116168 | A1 | 5/2009 | Block et al. |
| 2009/0207550 | A1 | 8/2009 | Feichtinger et al. |
| 2010/0014213 | A1 | 1/2010 | Wozniak et al. |
| 2010/0025075 | A1 | 2/2010 | Feichtinger et al. |

FOREIGN PATENT DOCUMENTS

| | | |
|---|---|---|
| DE | 199 31 056 | 1/2001 |
| DE | 102 24 565 | 12/2003 |
| DE | 102 35 011 | 2/2004 |
| DE | 103 92 149 | 9/2004 |
| EP | 1 369 881 | 12/2003 |
| EP | 0 929 084 | 5/2004 |
| EP | 1 391 898 | 9/2006 |
| JP | 11-297508 | 10/1999 |
| JP | 2001-035707 | 2/2001 |
| JP | 2003-347109 | 12/2003 |
| WO | WO03/063185 | 7/2003 |

OTHER PUBLICATIONS

Written Opinion for PCT/DE05/002183.

English translation for Written Opinion for PCT/DE2005/002183.

English Translation of International Preliminary Report on Patentability in Application No. PCT/DE2005/002183, dated Jul. 17, 2007.

English translation of examination report from corresponding application JP2007-543702 dated Sep. 10, 2010.

* cited by examiner

MULTI-LAYERED COMPONENT WITH SEVERAL VARISTORS HAVING DIFFERENT CAPACITIES AS AN ESD PROTECTION ELEMENT

TECHNICAL FIELD

This patent application relates to an electrical multi-layer component comprising ESD (electrostatic discharge) protective elements.

BACKGROUND

From publication DE 19931056 A1, a ceramic multi-layer varistor is known, which has internal electrodes opposite each other. Internal electrodes connected to the same electrical potential are arranged one above the other. Electrode stacks connected to different electrical potentials are arranged one alongside the other. This component is used as ESD protection for high-frequency circuits and data lines.

SUMMARY

Described herein is a multi-layer component, which has ESD protective elements. The component is suitable both as ESD protection for high-frequency circuits and data lines, and also as ESD protection for power-supply lines.

An electrical component is specified, in which a first varistor (with relatively large capacitance and power capacity) is formed by two overlapping electrodes and a varistor ceramic arranged therebetween, and in which a second varistor (with a relatively small capacitance due to its small active volume) is formed by two internal electrodes lying in one plane and a varistor ceramic arranged therebetween.

In this way it is possible to implement varistors that can be used for ESD protection for different lines of an electric circuit, with different capacitance values and power capacities in a basic element.

In one implementation, a multi-layer component is specified with a base body, on whose side surfaces are arranged external contacts, which are connected to internal electrodes arranged in the base body. The base body has several layers made from varistor ceramic (e.g., ZnO—Bi, ZnO—Pr), between which metallization layers are arranged with electrode structures embodied therein.

A first varistor is formed by a pair of internal electrodes arranged one above the other and the varistor ceramic arranged therebetween. A second varistor is formed by two internal electrodes arranged one alongside the other and the varistor ceramic arranged between its side surfaces facing each other.

The second varistor, which has a low capacitance, is suitable as ESD protection for a high-frequency line or data line and can be connected between this high-speed signal line and ground. The first varistor, which has a higher current-pulse capacity and also a significantly higher capacitance, can be connected between a current or voltage supply line and ground.

More than just one or two internal electrodes can be provided in one plane of the component.

Two main surfaces of the internal electrodes which are arranged one above the other, and which face each other in the vertical direction, span an active volume of the first varistor. The active volume of the first varistor may be least 0.001 $mm^3$. Two side surfaces of the internal electrodes, which face each other in the horizontal direction, and which are arranged one alongside the other, span an active volume of the second varistor. The active volume of the second varistor may be a maximum of 10% of the active volume of the first varistor.

The distance between the internal electrodes arranged one alongside the other may equal at least 20 μm.

The first and the second varistor may share the same internal electrode, which may be connected to ground, which represents, e.g., a common reference potential for high-frequency lines or data lines and power-supply lines.

The internal electrode connected to ground—e.g., the electrode with the largest surface area in the corresponding plane—may also be designated as the first electrode and the internal electrodes arranged in the same plane and lying alongside the first electrode may be designated as second electrodes. The internal electrode arranged in the other plane and lying opposite the first electrode may be designated as the third electrode and the internal electrodes arranged in the same plane and lying alongside the third electrode may be designated as fourth electrodes.

Second varistors arranged in the first plane are each formed by the first electrode, one of the second electrodes, and the varistor ceramic lying therebetween. Other second varistors arranged in the second plane are each formed by the third electrode, one of the fourth electrodes, and the varistor ceramic lying therebetween.

The first electrode may be arranged in a center of an appropriate plane. However, it is also possible for the first electrode to be arranged to one side of the first plane and the second electrodes are arranged to the opposite side of this plane.

The internal electrodes arranged one above the other may have substantially equal surface areas.

The distance between two second electrodes may be at least twice as large as the distance between the first and one of the second electrodes.

All of the features related to the first plane, first electrode, and second electrode can be transferred—as much as technically useful—to the second plane, third electrode, and fourth electrodes.

In the first plane, several first electrodes or a shared first electrode can also be provided.

The first plane may be divided in a lateral direction into two edge areas and a middle area arranged therebetween. The first electrode is arranged in the middle area and the second electrodes are arranged in the edge areas, the middle area being free of second electrodes.

The terminals of the first and third electrode may run outwards to opposing side surfaces of the base body. The terminals of the first and third electrode can alternatively run outwards to the same side of the base body or to different side surfaces arranged at a right angle to each other in the base body.

The terminals of the second or fourth electrodes can run outwards to the same side surfaces of the base body as the first or third electrode. In this example, only two side surfaces of the base body are occupied with external contacts. However, it is also possible to occupy all of the side surfaces of the base body with at least one external contact.

The first and second planes may have electrode structures that are dimensioned and arranged essentially equally.

Second and fourth electrodes allocated to each other can be arranged one above the other or offset relative to each other and can be connected to the same external contact.

The second varistors, which are constructed in different planes and whose electrodes are arranged one above the other, are connected on one side, e.g., to the same external contact. The second varistors constructed in the same plane may be connected to different external contacts, wherein each external contact can be connected to a unique signal line. In this way it is possible to eliminate interference on several high-speed signal lines with a single compact component.

In one variant, more than only one first varistor with high capacitance can be constructed, which is formed by another first electrode, another third electrode lying opposite it in the vertical direction, and a varistor ceramic arranged therebetween. Two first varistors can also have a common electrode, which can be connected to ground, wherein these varistors are each connected on the other side to a separate external contact or can each be connected to a separate power-supply line.

The first varistor can be realized in one variant by a stack of electrodes arranged one above the other (instead of only one pair of internal electrodes arranged one above the other). Here, first and third electrodes are arranged alternately in the vertical direction. Several alternately arranged first and second planes (with second or fourth electrodes) can also be provided.

The multi-layer component may be suitable for surface mounting. The external contacts are also constructed so that they each extend past the side surface of the base body and are arranged partially at least on the bottom main surface of the base body.

The switching voltage of a varistor formed in the vertical direction, i.e., the varistor voltage between the internal electrodes lying one above the other, may be at least 5 V at a current load of 1 mA. The varistor voltage may be a maximum of 250 V.

The switching voltage of a varistor formed in the horizontal direction, i.e., the varistor voltage between the internal electrodes lying one alongside the other, may be at least 10 V at a current load of 1 mA. The varistor voltage may be a maximum of 500 V.

In the following, embodiments are explained in more detail on the basis of associated figures. The figures show different embodiments on the basis of schematic representations not true to scale. Parts that are identical or that have an identical function are designated with the identical reference symbols.

DETAILED DESCRIPTION

FIGS. 1A to 1D show different views of a component with a base body GK that has several layers made from varistor ceramic. Between layers there is a first metallization plane E1 with internal electrodes IE10, IE11 formed therein and also a second metallization plane E2 with internal electrodes IE20, IE21 formed therein.

Figure 1A:
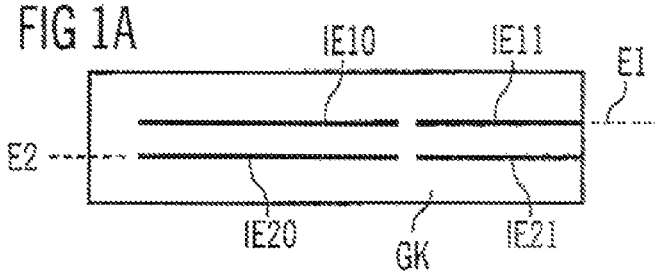
FIG. 1A, a varistor component with one first and two second varistors in cross section, FIG. 1B, the plan view onto the first plane of the component from FIG. 1A, FIG. 1C, the plan view onto the second plane of the component from FIG. 1A, FIG. 1D, the plan view onto the component from FIG. 1A from above (left), onto a first side surface (in the middle), and onto a second side surface (right), FIG. 1E, the equivalent circuit diagram of the component from FIGS. 1A to 1D, FIG. 2A, a component with one first varistor and four second varistors in cross section, FIG. 2B, the plan view onto the first plane of the component from FIG. 2A, FIG. 2C, the plan view onto the second plane of the component from FIG. 2A, FIG. 2D, a view of the component according to FIGS. 2A to 2C from above, FIG. 3A, a varistor component with one first varistor and four second varistors constructed in each plane, FIG. 3B, the plan view onto the first plane of the component from FIG. 3A, FIG. 3C, the plan view onto the second plane of the component from FIG. 3A, FIG. 3D, the view of the component from FIGS. 3A to 3C from above (left) and from the side (right), and FIG. 3E, an electrical equivalent circuit diagram of the component from FIGS. 3A to 3D.
Figure 1B:
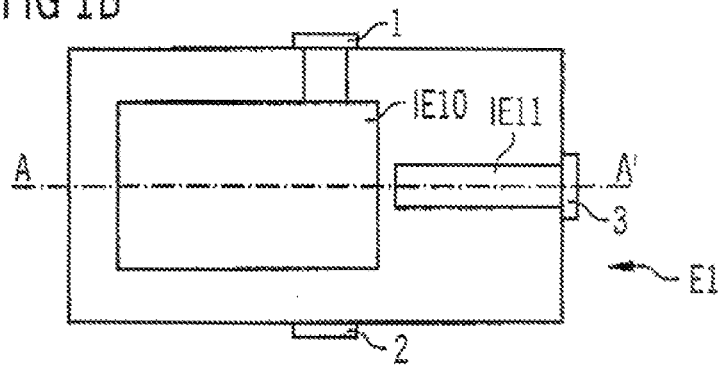
Figure 1C:
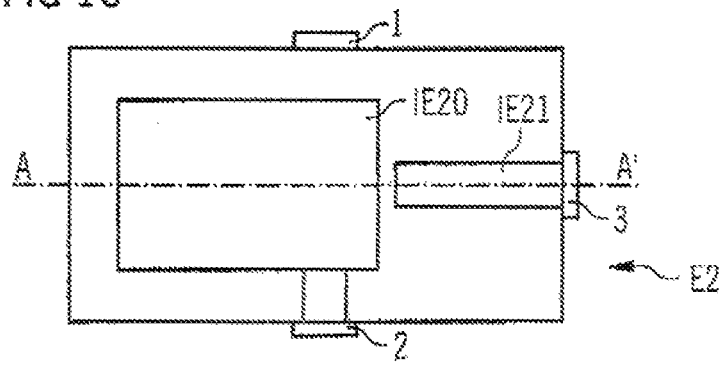

FIG. 1A corresponds to a cross section through the component along the line A-A' shown in FIGS. 1B and 1C. FIG. 1B shows the first plane E1 and FIG. 1C shows the second plane E2 of the component from FIG. 1A. The first internal electrode IE10 has a larger surface area than the second internal electrode IE11 arranged next to it. The third internal electrode IE20 arranged underneath the first internal electrode IE10 has a larger surface area than the fourth internal electrode IE21 arranged next to it or underneath the second internal electrode IE11.

The internal electrode IE10 is connected to an external contact 1 and the internal electrode IE20 is connected to an external contact 2. The internal electrodes IE11, IE21 are connected to another external contact 3. The external contacts 1 and 2 are arranged on opposite first side surfaces of the base body GK. The external contact 3 is arranged on a second side surface of the base body GK, which is at a right angle to the first side surfaces. In this variant, only three side surfaces are occupied with external contacts.

A first varistor (varistor V1 in FIG. 1E) is formed by the opposing internal electrodes IE10, IE20 and a varistor ceramic arranged therebetween. The first internal electrode IE10 and the third internal electrode IE20 may have the same surface areas.

A second varistor V21 is formed by the internal electrodes IE10, IE11 arranged one alongside the other in the first plane E1 and a varistor ceramic arranged therebetween. Another second varistor V25 is formed by the internal electrodes IE20, IE21 arranged one alongside the other in the second plane E2 and a varistor ceramic arranged therebetween.

The active volume of a varistor is understood to be the volume of a varistor material arranged between two electrodes. The active volume of the first varistor V1 is spanned between the main surfaces of the internal electrodes IE10 and IE20 facing each other and equals at least 0.001 $mm^3$. The active volume of the second varistor V21 is spanned between opposing side surfaces of the first internal electrode IE10 and the second internal electrode IE11. The active volume of the second varistor V21 is significantly smaller than the active volume of the first varistor V1—e.g., by at least one order of magnitude, e.g., by at least two orders of magnitude.

Figure 1D:
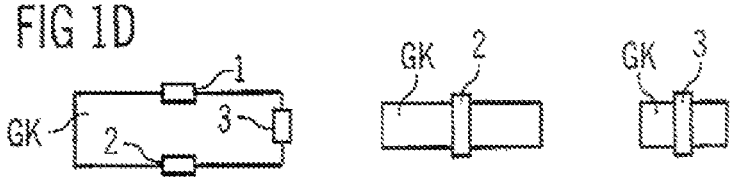
Figure 1E:
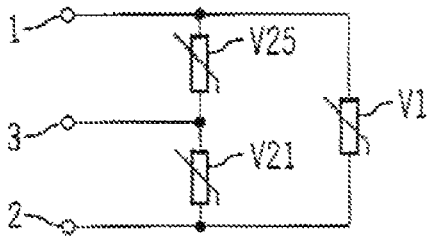

At the left, in FIG. 1D, a view of the component from FIGS. 1A to 1C is shown from above, in the middle the plan view onto the first side surface is shown, and at the right, the plan view onto the second side surface of the component is shown. The external contacts 1, 2, 3 extend past the corresponding side surface and are partially arranged on a main surface (e.g., the bottom side) of the base body, where they form electrical connections of the component that are suitable for surface mounting.

In this example, the internal electrodes IE11 and IE21 connected to the same electrical potential are arranged one above the other. In one implementation, it is possible for these electrodes to be offset laterally relative to each other.

It is advantageous if the first and the third internal electrodes IE10, IE20 are connected to the external contacts arranged on opposing side surfaces. It is also possible, however, to connect the internal electrodes IE10, IE20 to the external contacts that are arranged on the side surfaces at right angles to each other, or on the same side surface.

Figure 2D:
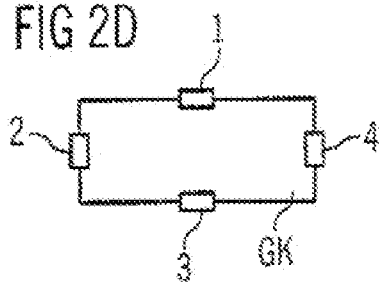
Figure 3A:
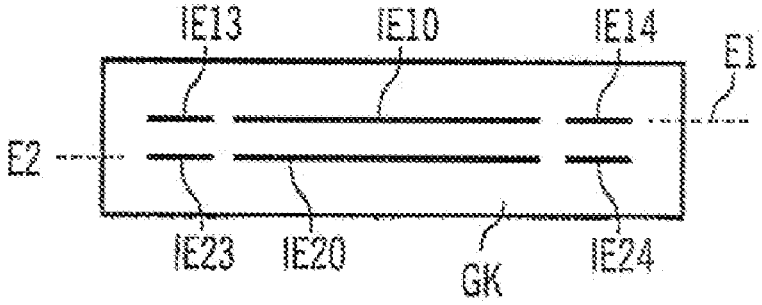
Figure 3B:
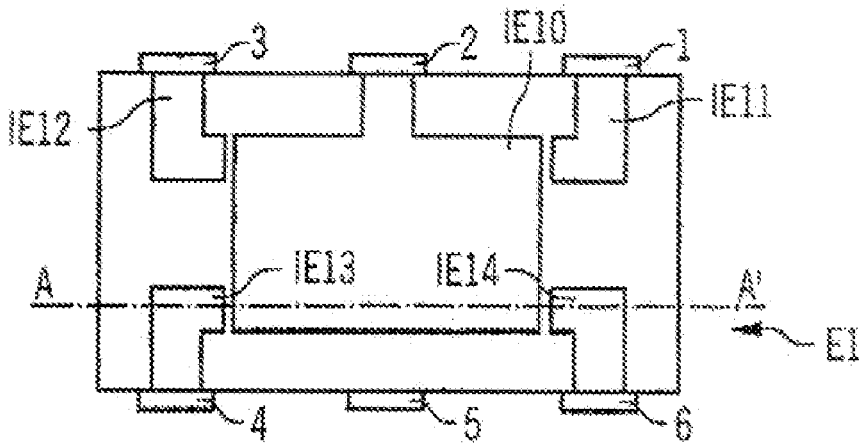
Figure 3C:
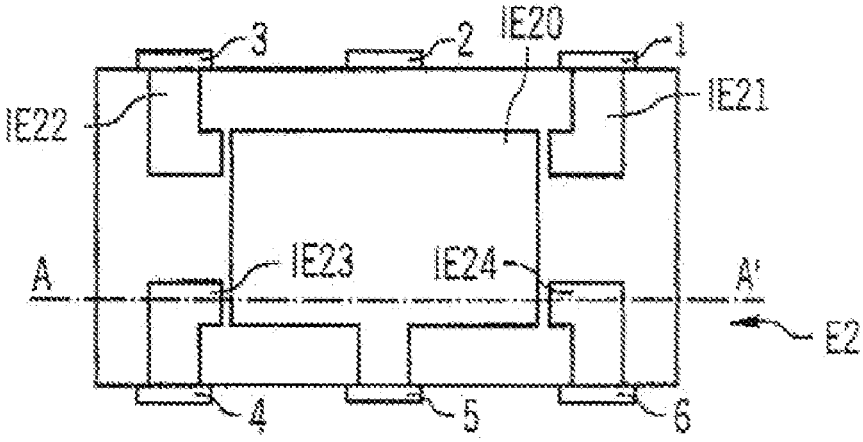
Figure 3D:
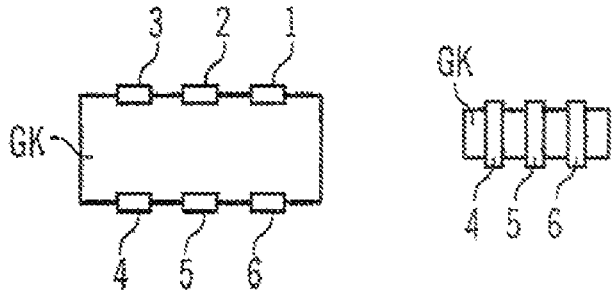

All of the external contacts of the component can be arranged as in FIG. 3D on opposing first side surfaces of the component, with the second side surfaces of the base body at right angles to the first surfaces being free of external contacts. It is also possible, however, for all of the side surfaces of the base body to be occupied with external contacts, as in the variant from FIG. 2D.

Figure 2A:
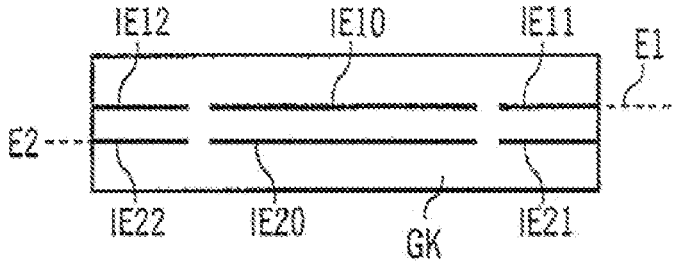
Figure 2B:
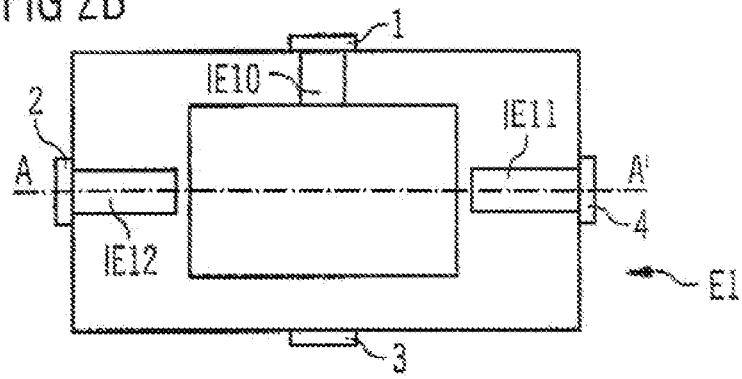
Figure 2C:
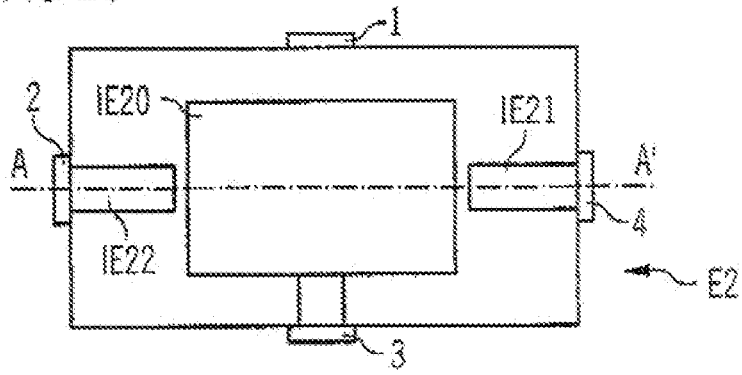

In FIG. 2A, another variant is shown, in which the first internal electrode IE10 in the first plane E1 is arranged between two second internal electrodes IE11, IE12, and the third internal electrode IE20 in the second plane E2 is arranged between two fourth internal electrodes IE21, IE22. The first varistor V1 and the second varistors V21, V25 are formed here and in the variant presented in FIGS. 3A to 3E as in FIGS. 1A to 1E.

In the plane E1, another second varistor is formed by the internal electrodes IE10, IE12 and a varistor ceramic arranged therebetween. In the second plane E2, another second varistor is formed by the internal electrodes IE20, IE22 and a varistor ceramic arranged therebetween.

In FIGS. 3A to 3D, different views are shown of another varistor component, which comprises a total of eight second varistors. FIG. 3A shows this component in a schematic cross section along line A-A'. FIGS. 3B, 3C show the plan view onto the first plane E1 and second plane E2 of the component, respectively. In the first plane E1, a first internal electrode IE10 and four second internal electrodes IE11, IE12, IE13, and IE14 are arranged. The first internal electrode IE10 is arranged in the plane E1 in the center between two groups of second internal electrodes. In the second plane E2 there is a third internal electrode IE20 and four fourth internal electrodes IE21, IE22, IE23, and IE24. The third internal electrode IE20 is arranged in the plane E2 in the center between two groups of fourth internal electrodes.

The second varistors are formed in the first plane E1 by a second internal electrode, the side surface of the first internal electrode IE10 opposite it, and the varistor ceramic arranged therebetween. The additional second varistors are formed in the second plane E2 by a fourth internal electrode, the side surface of the third internal electrode IE20 opposite it, and the varistor ceramic arranged therebetween.

Figure 3E:
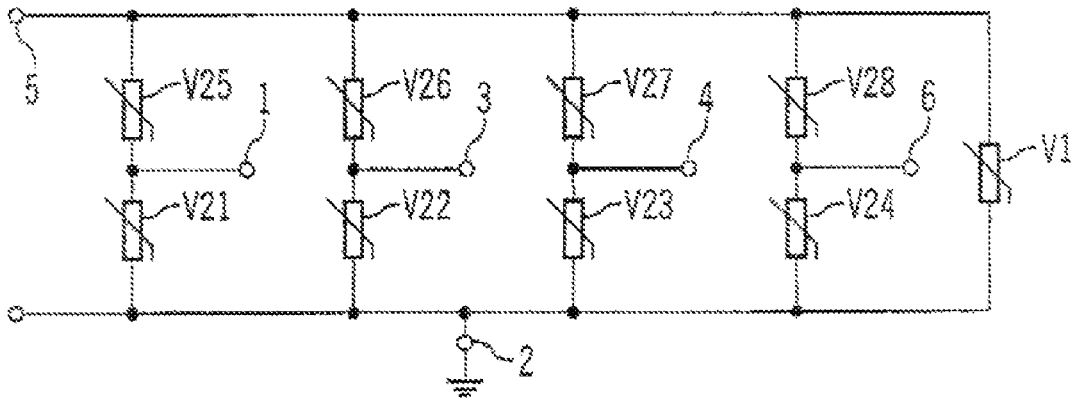

The equivalent circuit diagram of the component presented in FIGS. 3A to 3D is shown in FIG. 3E. The first varistor V1 is connected between the external contacts 2 and 5. The external contact 2 is set to ground. All of the second varistors V21 to V28 are connected to the external contact 2. The second varistor V21 defined by the internal electrodes IE10 and IE11 is connected to the external contact 1. The second varistor V22 defined by the internal electrodes IE10 and IE12 is connected to the external contact 3. The second varistor V23 defined by the internal electrodes IE10 and IE13 is connected to the external contact 4, and the second varistor V24 defined by the internal electrodes IE10 and IE14 is connected to the external contact 6. The other second varistors V25 to V28 are formed in a manner corresponding to the second varistors V21 to V24 in the second plane E2 of the component.

The claims are not limited to the embodiments shown in this publication or to the number of illustrated elements. It is possible to arrange the electrode pair formed by the first and third internal electrodes arbitrarily in the corresponding metallization planes. It is possible to divide the first or third internal electrode into, e.g., two equal-area sub-electrodes and to connect these sub-electrodes to a separate electrical external contact.

What is claimed is:

1. An electrical component comprising:

a first varistor comprising:

first electrodes; and ceramic between the first electrodes;

wherein at least part of the first electrodes overlap vertically;

a second varistor comprising:

second electrodes; and ceramic between the second electrodes;

wherein the second electrodes are in a substantially same horizontal plane; and a base body comprising side surfaces and external contacts on the side surfaces;

wherein the first and second electrodes are at least partly inside the base body, each of the first and second electrodes being connected to a corresponding external contact wherein the second electrodes comprise a first internal electrode and a second internal electrode in a first plane;

wherein the first electrodes comprise a third internal electrode in a second plane that overlaps at least part of the first internal electrode;

wherein the first varistor comprises the first internal electrode, the third internal electrode, and ceramic between the first internal electrode and the third internal electrode; and wherein the second varistor comprises the first internal electrode, the second internal electrode, and ceramic between the first internal electrode and the second internal electrode.

2. The electrical component of claim 1, further comprising:

additional internal electrodes;

wherein one or more additional varistors comprise the first internal electrode, one or more of the additional internal electrodes, and ceramic between the first internal electrode and the one or more additional internal electrodes.

3. The electrical component of claim 1, wherein a distance between two additional internal electrodes is at least twice as large as a distance between the first internal electrode and an additional internal electrode.

4. The electrical component of claim 1, further comprising:

a fourth internal electrode;

wherein a third varistor comprises the fourth internal electrode, the third internal electrode, and ceramic between the fourth internal electrode and the third internal electrode.

5. The electrical component of claim 1, further comprising one or more additional internal electrodes;

wherein one or more additional varistors comprise the third internal electrode, one or more of the additional internal electrodes, and ceramic between the third internal electrode and the one or more additional internal electrodes.

6. The electrical component of claim 1, wherein the first and third internal electrodes comprise an active varistor volume of at least 0.001 $mm^3$.

7. The electrical component of claim 6, wherein a distance between the first and second internal electrodes is at least 20 μm.

8. The electrical component of claim 1, wherein the first internal electrode has a larger surface area than the second internal electrode.

9. The electrical component of claim 1, wherein the first internal electrode is in about a center of the first plane.

10. The electrical component of claim 1, wherein the first internal electrode or the third internal electrode is electrically connected to ground.

11. The electrical component of claim 1, wherein the ceramic comprises ZnO—Bi or ZnO—Pr.

12. The electrical component of claim 1, wherein a voltage between the second electrodes is a maximum of 500 V at a current of 1 mA.

13. The electrical component of claim 2, further comprising one or more additional second internal electrodes;

wherein one or more additional second varistors comprise the third internal electrode, one or more of the additional second internal electrodes, and ceramic between the third internal electrode and the one or more additional second internal electrodes.

14. The electrical component of claim 13, wherein the ceramic comprises ZnO—Bi or ZnO—Pr.

15. The electrical component of claim 1, wherein the base body comprises a main surface that is at an angle relative to the side surfaces;

wherein at least one of the external contacts extends over at least part of the main surface.

16. The electrical component of claim 1, wherein the first electrodes are offset laterally from each other.

17. The electrical component of claim 1, wherein the first electrodes are substantially vertically aligned.

18. The electrical component of claim 1, wherein the first electrodes have substantially same surface areas.

19. The electrical component of claim 1, wherein an active volume of the second varistor is smaller than an active volume of the first varistor.

20. The electrical component of claim 1, further comprising external contacts;

wherein each of the first electrodes of the first varistor is electrically connected to a different external contact.

21. The electrical component of claim 1, wherein each of the second electrodes of the second varistor is electrically connected to a different external contact.

22. The electrical component of claim 1, wherein the first internal electrode, the second internal electrode, and the third internal electrode are connected to different ones of the external contacts.

* * * * *

UNITED STATES PATENT AND TRADEMARK OFFICE

CERTIFICATE OF CORRECTION

PATENT NO. : 7,986,213 B2
APPLICATION NO. : 11/720704
DATED : July 26, 2011
INVENTOR(S) : Thomas Feichtinger et al.

It is certified that error appears in the above-identified patent and that said Letters Patent is hereby corrected as shown below:

On the Title Page, Item (54) and Col. 1, lines 1-4
Title:
Delete "MULTI-LAYERED COMPONENT WITH SEVERAL VARISTORS HAVING DIFFERENT CAPACITIES AS AN ESD PROTECTION ELEMENT" and
Insert -- MULTI-LAYERED COMPONENT WITH ESD PROTECTION ELEMENTS --

Column 6, Claim 1, Line 20
Delete "contact" and Insert -- contact; --

Column 6, Claim 3, Line 41
Delete "claim 1," and Insert -- claim 2, --

Signed and Sealed this
Sixth Day of March, 2012

David J. Kappos

David J. Kappos
*Director of the United States Patent and Trademark Office*